United States Patent [19]

Means

[11] 3,944,464

[45] Mar. 16, 1976

[54] FORMING SECTION FOR TWIN-WIRE PAPERMAKING MACHINE

[75] Inventor: John A. Means, Norwalk, Conn.

[73] Assignee: International Paper Company, New York, N.Y.

[22] Filed: May 10, 1974

[21] Appl. No.: 468,732

[52] U.S. Cl. ..... 162/273; 162/301; 162/352

[51] Int. Cl.[2] ..... D21F 1/00

[58] Field of Search ..... 162/301, 303, 352, 374, 162/203, 211, 273

[56] References Cited

UNITED STATES PATENTS

| | | | |
|---|---|---|---|
| 3,578,561 | 5/1971 | McCarrick et al. | 162/352 |
| 3,623,945 | 11/1971 | Tommeraasen | 162/273 |
| 3,726,758 | 4/1973 | Parker et al. | 162/301 X |
| 3,810,818 | 4/1974 | Arledter | 162/301 |
| 3,839,143 | 10/1974 | Suckow | 162/301 X |

*Primary Examiner*—Robert L. Lindsay, Jr.
*Assistant Examiner*—Richard V. Fisher
*Attorney, Agent, or Firm*—Fitch, Even, Tabin & Luedeka

[57] ABSTRACT

The web-forming section of a twin-wire papermaking machine includes a plurality of sets of web deflectors. Alternate sets are disposed on opposite sides of a pair of forming carriers between which a water suspension of fibers is disposed. Each set of deflectors has a plurality of deflectors providing forming carrier guiding surfaces spaced along a gentle convex curve. The sets of deflectors are disposed to guide the forming carriers over a tortuous path through the forming section. The tension in the forming carriers presses the outer carrier against the inner carrier at each curve, expressing water from the suspension through the carriers. The expressed water is doctored off by the deflectors.

5 Claims, 3 Drawing Figures

FORMING SECTION FOR TWIN-WIRE PAPERMAKING MACHINE

This invention relates generally to papermaking machines and more particularly to an improved web-forming section for a vertical twin-wire papermaking machine.

In vertical twin-wire papermaking machines of the prior art, an aqueous suspension of papermaking fibers, known as stock, is forced in the form of a broad jet from a chamber, known as a headbox, through an orifice, commonly known as a slice, between a pair of converging endless foraminous forming carriers, commonly known as wires, moving substantially vertically downward toward and through a forming section where a web of fibers is formed. The web is then further dewatered and dried to form paper in a conventional manner, as by suction boxes, presses and dryers.

In prior art forming sections it is known to force deflector blades against the pair of forming carriers with alternate blades widely spaced apart on opposite sides of the pair of forming carriers, causing the pair of carriers to change direction abruptly at each blade and take a tortuous path through the forming section. The carriers are kept under substantial tension so that at each change in direction the tension in the outer carrier urges the outer carrier against the inner carrier with the suspension of fibers therebetween. This creates pressure on the suspension, forcing water therefrom through the respective carriers. This water is then doctored off the carriers by the next blades. As the water is removed from the suspension, a fiber web is formed.

While prior art papermaking machines utilizing forming sections of this sort have been successfully used to make paper, they have a number of shortcomings. The relatively sharp change in direction at each blade produces a relatively harsh dewatering action at the blade with relatively little pressure being exerted on the suspension between blades. This produces relatively uneven dewatering with the sudden bursts of dewatering creating substantial disruption of the forming web, while at the same time producing relatively little dewatering between blades. Further, the repetitive sharp bending of curves, first in one direction and then the other, has produced substantial wear of the carriers, resulting in relaltively short life.

In accordance with the present invention, an improved web-forming section is provided by utilizing deflectors in sets rather than singly. As with the single deflectors of the prior art, the sets are spaced apart along the path of the pair of forming carriers on opposite sides thereof. The sets are disposed for guiding the carriers with the forming web therebetween along a tortuous path through the forming section. Each set of deflectors includes a plurality of deflectors each having a guiding surface for engaging the near one of the carriers. The forming carrier-engaging surfaces of each set are relatively closely spaced apart in the direction of the path along a relatively gentle convex curve. This distributes the forces and avoids the relatively sharp change in direction at each blade as provided by the single blades of the prior art. Although this reduces the pressure on the suspension at any one deflector for a given carrier tension, the pressure is exerted at a larger number of deflectors and the relatively close spacing of the deflectors assures pressure in the interval between deflectors. Thus, the exertion of pressure over an entire set of deflectors increases drainage while at the same time providing a more gentle development of drainage pressure and consequently a more uniform formation of the web. At the same time, the lesser bending at each deflector reduces wear upon the carriers. Further, the increased drainage of a set of deflectors over that of a single deflector permits a reduction in the number of reverse curves. Indeed, in a preferred embodiment of the invention, three sets of deflectors are used to provide three gentle curves as opposed to as many as eight single deflectors providing relatively sharp bends in the prior art apparatus. An additional advantage to utilizing sets of deflectors is that each set may be connected to suction to suck water from the suspension in the spaces between deflectors, thus providing additional water removal capability.

It is thus an object of the invention to provide an improved forming section for a twin-wire papermaking machine by providing sets of deflectors for the forming carriers, the additional elements providing increased drainage and the arrangement of the deflectors in a gentle convex curve providing gentle drainage. It is a further object of the invention to deflect the carriers gently in the same direction over a number of deflectors comprising a set and then in the opposite direction over a number of deflectors comprising another set to avoid excessive bending of the carriers back and forth, thus improving the life of the carriers. Other objects and advantages of the invention will become apparent from the following detailed description, particularly when taken in connection with the appended drawings wherein:

Figure 1:
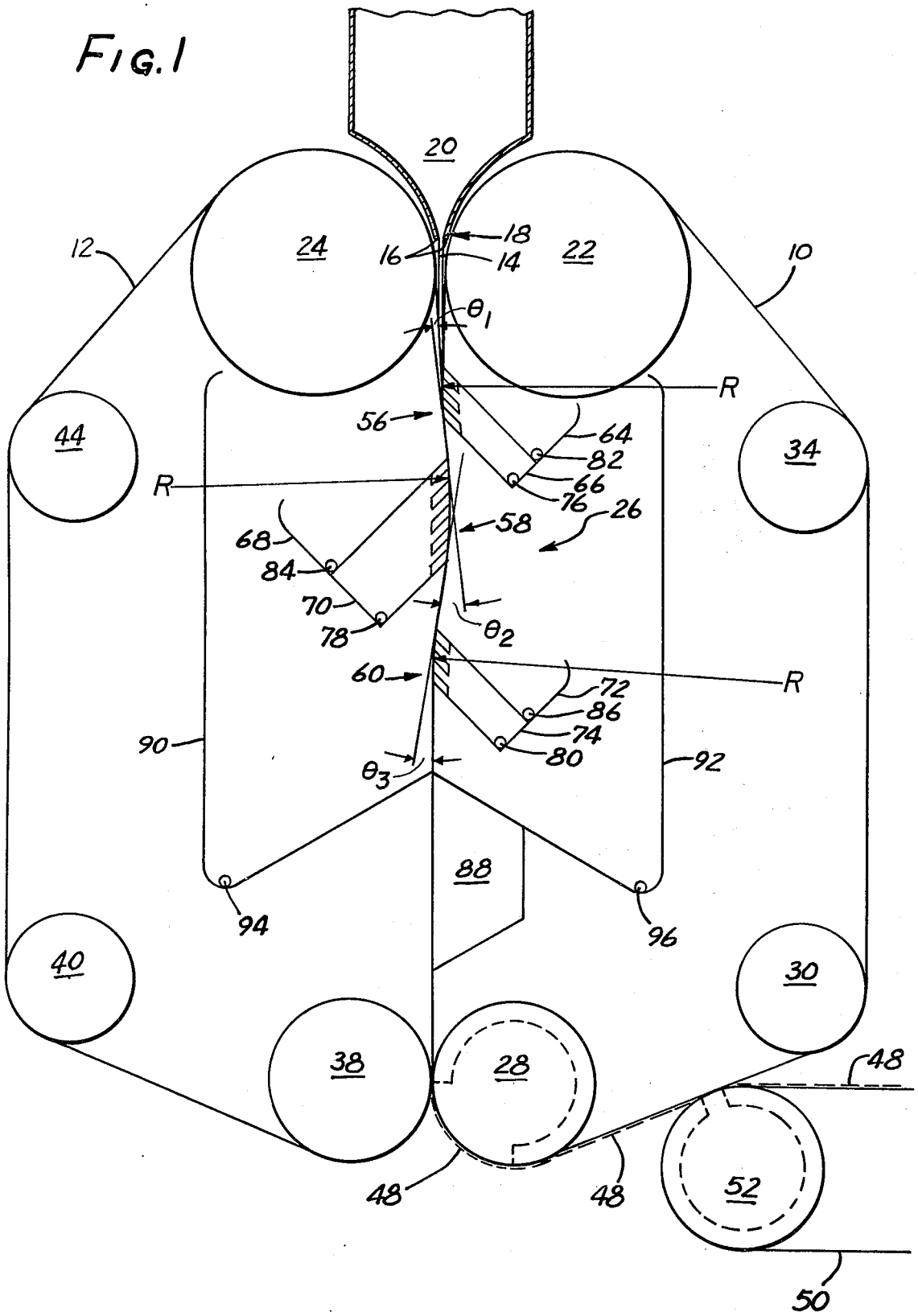
FIG. 1 is a fragmentary elevational view, partly in section and partly diagrammatic, schematically representing a papermaking machine embodying a web-forming section according to the present invention.
Figure 2:
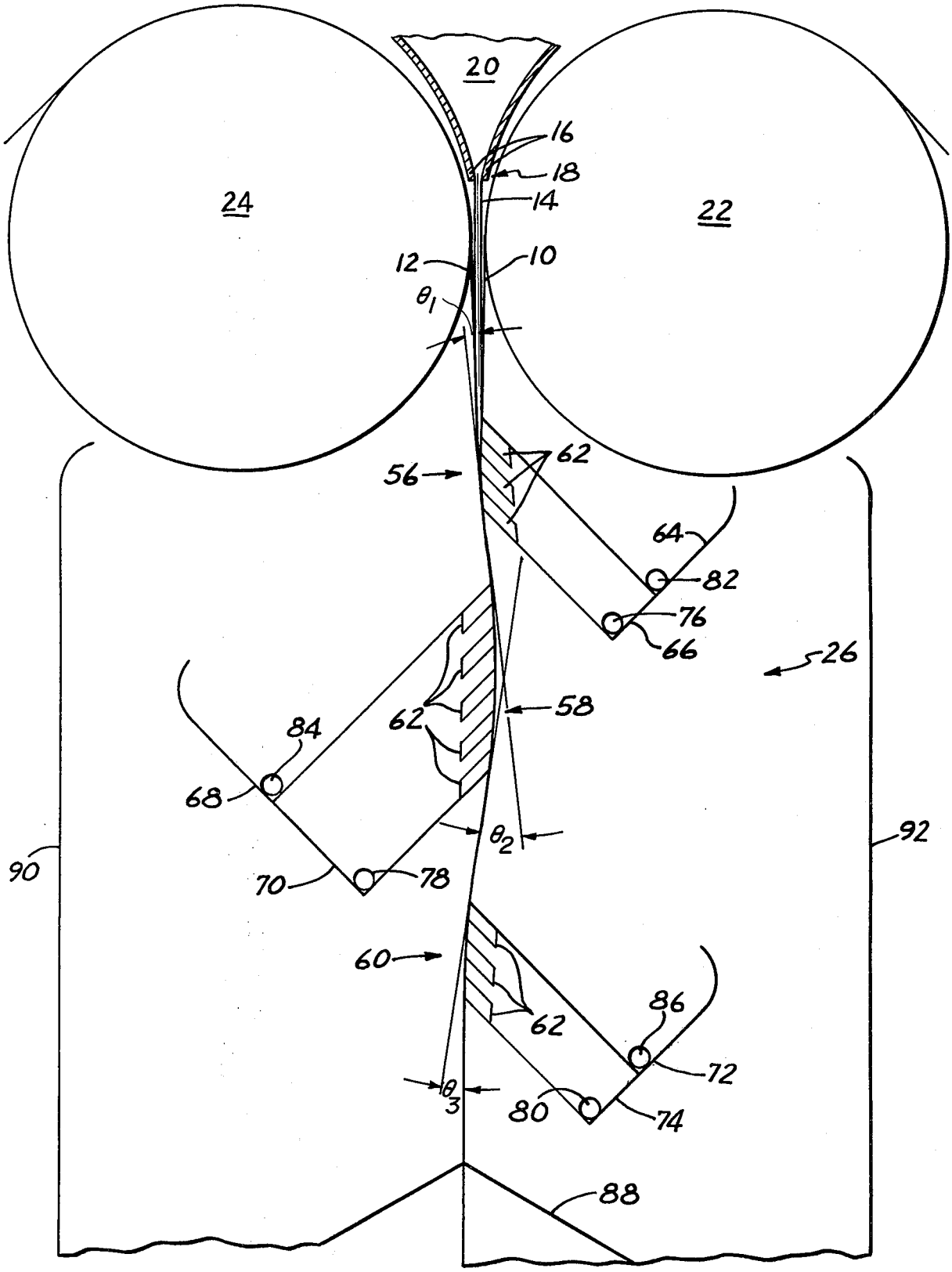
FIG. 2 is a more detailed view, partly in section, illustrating a preferred form of the web-forming section of the present invention.

Referring to the drawings, particularly FIG. 1, a papermaking machine incorporating a web-forming section according to the present invention is illustrated in the form of a vertical twin-wire papermaking machine. The machine is known as a vertical twin-wire machine because the paper web is formed between a pair of endless foraminous forming carriers 10 and 12 moving substantially vertically through a forming section, the forming carriers being often referred to as wires irrespective of whether or not they are actually made of metal wire. Because the formed web is carried away from the forming section by the forming carrier 10, it may be referred to as the conveying wire while the forming carrier 12 may be referred to as the backing wire.

The fiber suspension or stock is directed between the forming carriers 10 and 12 in the form of a free jet 14 from the lips 16 forming the outlet orifice or slice 18 of a headbox 20. At the entry of the jet 14 between the forming carriers 10 and 12, the carriers are supported by spaced apart breast rolls 22 and 24, respectively. The forming carriers 10 and 12 with the stock suspension therebetween is then passed through a forming section 26 where water is removed from the suspension to form the fiber web. The forming carrier 10 is supported for movement over the desired path by rolls 28, 30, and 34 as well as by the breast roll 22. The forming carrier 12 is supported for movement over the desired path by rolls 38, 40, and 44 as well as the breast roll 24. Various of the rolls may be driven in a conventional manner to drive the forming carriers 10 and 12 at the desired speed along the desired path. Rolls 30 and 40 may be made laterally adjustable to place the respective forming carriers in appropriate tension.

The forming carriers 10 and 12 having been passed together through the forming section 26 are parted at rolls 28 and 38. The web 48 formed in the forming section passes around the roll 28 with the forming carrier 10. If necessary or desirable, additional means may be provided to assure that the formed web 48 follows the forming carrier 10 about the roll 28. The formed web 48 may then be transferred to a fabric or felt 50 supported by roll 52. The web 40 is carried on the fabric or felt 50 to pressing and drying sections which dry the web to finished paper in a conventional manner.

In accordance with the present invention, the forming section 26 includes a plurality of sets 56, 58 and 60 of deflectors 62 with alternate sets on opposite sides of the forming carriers 10 and 12 and spaced apart along the path of the forming carriers. Each of the sets 56, 58, 60 is comprised of a plurality of deflectors 62 which are closely spaced from one another along the path of the forming carriers 10 and 12 through the forming section 26. Each deflector 62 has a carrier-engaging surface extending substantially straight across the papermaking machine perpendicular to the direction of the path of travel of the forming carriers 10 and 12. The surfaces of the deflectors of each set lie generally on a gentle convex curve in the direction of the path of travel of the carriers, that is, on a curve curving away from the carriers, the carriers being deflected an angle $\theta$ at each deflector. The alternate sets being on opposite sides of the path, the carriers with the forming web therebetween are guided by the deflectors 62 along a tortuous path through the forming section 26. In a vertical twin-wire former, the path of the forming carriers through the forming section 26 is preferably kept within about 0.25 radians of vertical. That is, $\Sigma\theta \leq 0.25$, where $\Sigma\theta$ is the sum of all deflections $\theta$ up to any point in such path through the forming section.

The upstream deflector 62 of the first set of deflectors 56 is preferably disposed directly below the breast roll 22 in order that the conveying wire 10 moves substantially vertically into the forming section. The stock jet 14 is directed to strike the conveying wire somewhat after the wire leaves the breast roll 22 in order that the breast roll not impede the jet and retard the flow into the nip between the forming carriers. The spacing between the breast rolls 22 and 24 permits the free flow of the stock jet 14 into the nip between the forming carriers 10 and 12. At the same time, the spacing is such that, as the forming carriers converge at the first deflector 62, water starts to flow through the forming carriers a short distance upstream of the first deflector, as from one inch to a few inches upstream thereof. The relative rates of the stock jet 14 and the forming carriers 10 and 12, as well as the spacing between the forming carriers, assures that the stock is carried through the nip without ponding at the entrance of the nip.

As shown, the first set 56 of deflectors preferably deflects the pair of forming carriers from vertical through an angle $\theta_1$ of about 0.1 radians. The second set 58 preferably deflects the carriers through an angle $\theta_2$ of about 0.2 radians in the opposite direction to through an angle $\theta_3$ of about 0.1 radians from vertical in the other direction. Then the third set 60 preferably curves the path back through the angle $\theta_3$ another 0.1 radians to substantially vertical, in line with the path as it entered the forming section 26. The carrier-engaging surfaces are disposed to guide the forming carriers along gentle convex curves, which may be circular. The radius of curvature R of the overall convex curve on which the guiding surfaces of each respective set of deflectors are disposed is at least about 2 feet, preferably about 5 feet and no more than about 15 feet. The deflection at each deflector should be limited to no more than about 0.05 radians, and at least three deflectors per set are preferred. The spacing between the carrier-engaging surfaces of the respective deflectors 62 is relatively short, preferably less than about 2 inches. The carriers are held by their tension against the successive carrier-engaging surfaces. The relatively short span between surfaces assures that the pressure on the suspension between the carriers is not greatly relieved in the interval. The tension on the forming carrier 10 or 12 on the outside of the convex curve at each deflector set 56, 58, 60 holds that carrier against the other carrier with the draining stock in between. The pressure thus created expresses water from the suspension to the outer sides of the respective forming carriers.

As shown, the deflectors 62 extend from the carrier-engaging surfaces at an acute angle to the downstream direction of the path. The carrier-engaging surfaces themselves may be flat or rounded. They may be about the size of the spaces between them. Their leading edge is such as to doctor the expressed water from the outer surfaces of the carriers 10 and 12 without gouging the carriers or forcing the water back through the carriers. The water doctored off may be run into catch basins 64, 66, 68, 70, 72 and 74. If desired, the catch basins 66, 70 and 74 may be sealed to the respective deflectors 62 and evacuated through respective ports 76, 78 and 80 to enhance water removal. Water may be removed from catch basins 64, 68 and 72 through respective ports 82, 84 and 86.

Following the last deflector set 60, the forming carriers 10 and 12 with the web therebetween pass over a suction box 88 for further dewatering. The web is then carried around the roll 28 on the carrier 10 and deposited on the fabric or felt 50 for pressing and drying. Catch basins 90 and 92 are disposed at the suction box 88 to catch water from the respective sides of the carriers. The catch basins 90 and 92 are drained through respective ports 94 and 96.

The preferred embodiment of the present invention as shown and described was designed for operation in a vertical twin-wire papermaking machine operating at a wire speed of about 1,000–5,000 feet per minute. Relative dimensions may be changed for different operating speeds and other conditions. It is also within the scope of the present invention to operate in positions other than vertical, such as horizontal.

Various other modifications may be made within the scope of the present invention. For example, it may be desirable to have a greater or lesser number of sets of deflectors, or it may be desirable that each set provide a different curvature.

The pressure between the wires is directly proportional to the tension in the carrier on the outside at each curve and substantially inversely proportional to the overall radius of curvature of the respective set of deflectors. As friction is made relatively small, the tension is relatively constant through the forming zone. Thus, the pressure between the wires at the respective sets of deflectors can be made different by using different radii of curvature.

Depending upon desired paper qualities, such as surface smoothness, bonding, permeability, or upon other desiderata, such as maximizing fiber retention in a manner compatible with paper quality requirements, it may be desirable that drainage of water from the stock be effected at a uniform rate, or preferentially early, or preferentially late. This may be achieved, in accordance with the present invention, by appropriate selection of radii of curvature of the sets of deflectors. It is also possible that the radius of curvature change along a single set.

Figure 3:
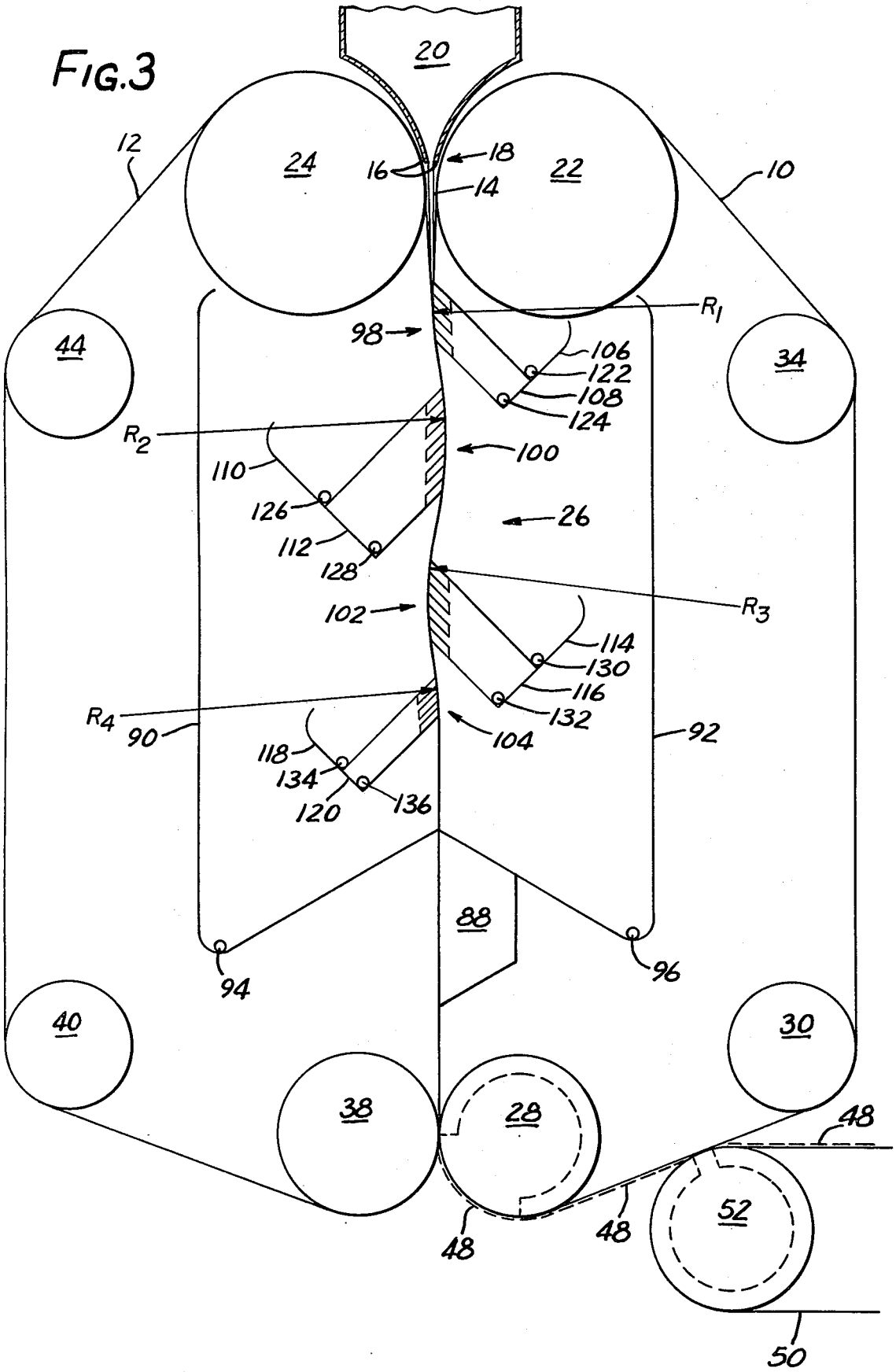
FIG. 3 is a view, partly in section, illustrating a modified form of the web-forming section of the present invention.

The embodiment of the invention illustrated in FIG. 3 provides four sets 98, 100, 102 and 104 of deflectors 62 providing respective curves having progressively shorter radii of curvature, $R_1>R_2>R_3>R_4$. Water is collected in respective catch basins 106, 108, 110, 112, 114, 116, 118 and 120 from which water is removed through respective ports 122, 124, 126, 128 130, 132, 134 and 136.

It is also possible to vary the rates of water removal by varying the amount of suction at the respective sets of deflectors.

What is claimed is:

1. In a web-forming machine having means for passing a water suspension of fibers between a pair of endless foraminous forming carriers supported under tension for movement over respective paths into and through a web-forming section, the improved web-forming section comprising A. a plurality of sets of deflectors disposed with alternate sets spaced apart along said path on opposite sides of said pair of forming carriers for guiding said forming carriers for movement together with the fibers therebetween along a tortuous path through said web-forming section, said path deviating from vertical by no more than about 0.25 radians, B. each of said sets of deflectors comprising 1. at least three deflectors spaced apart along said path and each having respective carrier-engaging surfaces for guiding said carriers for movement over a convex curve having an overall radius of curvature of at least about two feet with a change in direction at each deflector of less than about 0.05 radians,
2. each of said deflectors having its said carrier-engaging surface extending substantially straight and perpendicular to the direction of said path, and each of said deflectors extending away from said surface at an acute angle to the downstream direction of said path, whereby the tension in the respective forming carrier on the outside at each such curve presses said forming carriers together to express water from said suspension through said forming carriers, said sets of deflectors removing water from the respective forming carrier on the inside at each such curve.

2. Apparatus according to claim 1 wherein each of said convex curves has an overall radius of curvature of less than about 15 feet.

3. Apparatus according to claim 1 wherein the overall radii of curvature of the respective curves are different.

4. Apparatus according to claim 3 wherein the overall radius of curvature of a respective curve is less than that of the curve preceding it.

5. Apparatus according to claim 1 wherein said deflectors of each respective set are spaced apart by less than about 2 inches.

* * * * *